United States Patent [19]

Shy

[11] 4,179,143

[45] Dec. 18, 1979

[54] FIXED LATCH LOCK

[76] Inventor: Min C. Shy, No. 20, Alley 18, Lane 109, Hoping St., Yang Ho Town, Taipei, Taiwan

[21] Appl. No.: 873,981

[22] Filed: Jan. 31, 1978

[51] Int. Cl.[2] ..... E05C 1/10

[52] U.S. Cl. ..... 292/179; 292/150; 292/DIG. 37

[58] Field of Search ..... 292/179, 150, 151, 269, 292/106, DIG. 37, DIG. 61, 254, 255

[56] References Cited

U.S. PATENT DOCUMENTS

| | | | |
|---|---|---|---|
| 475,368 | 5/1892 | Welch | 292/179 X |
| 914,065 | 3/1909 | Newhart | 292/179 |
| 1,198,509 | 9/1916 | Anderson | 292/179 |
| 3,768,847 | 10/1973 | Buck, Jr. et al. | 292/179 |
| 3,893,721 | 7/1975 | Upton | 292/DIG. 37 X |

FOREIGN PATENT DOCUMENTS

| | | | |
|---|---|---|---|
| 13910 | of 1916 | United Kingdom | 292/150 |

*Primary Examiner*—Roy D. Frazier
*Assistant Examiner*—William E. Lyddane
*Attorney, Agent, or Firm*—Karl W. Flocks

[57] ABSTRACT

A fixed latch lock structure including a housing, at the rear and the front of which is symmetrically located a hole at each end with a movable shaft latch passing through. The shaft latch can be latched forward in a fixed hole in a fixed stand manually and can promptly press back automatically from the latching position to where it was by the controlling of the following installation: a control plate in the housing, a spring sheet at the bottom of the housing and the spring extending around on the shaft latch.

3 Claims, 8 Drawing Figures

FIG. 1
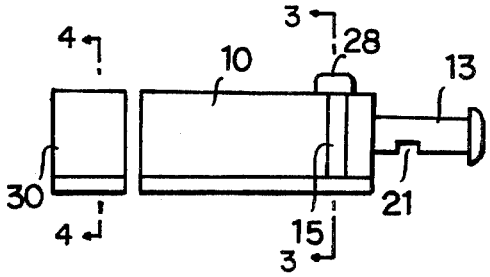
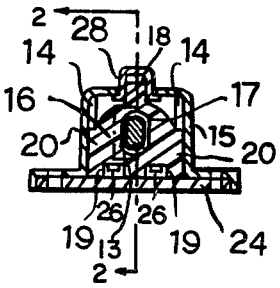
FIG. 3
FIG. 2
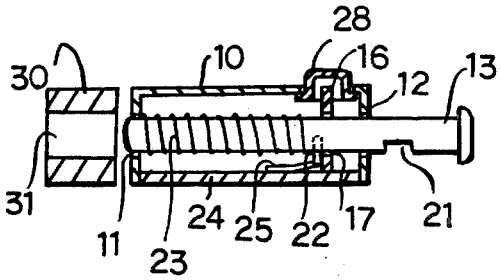
FIG. 4
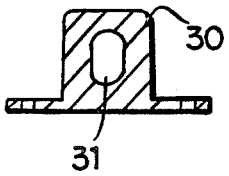
FIG. 6
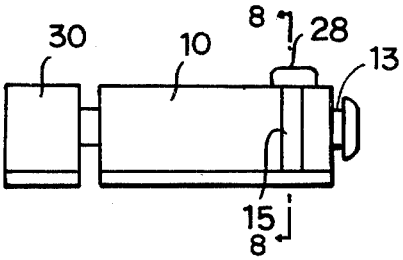
FIG. 5
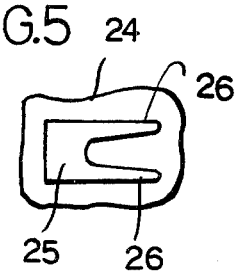
FIG. 7
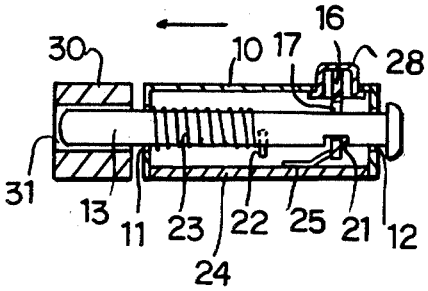
FIG. 8
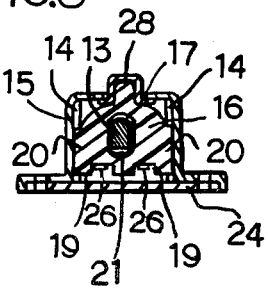

FIXED LATCH LOCK

SUMMARY OF THE INVENTION

This invention relates to a fixed latch lock and, more particularly, to a lock which can fixedly latch and open promptly.

Heretofore, many types of fixed latch locks have been proposed for practical use, but of all those which were installed, no open sets are known to include structure which can press back to where it was automatically.

It is, therefore, an object of the invention to provide a fixed latch lock, wherein a shaft latch which can press back from the latching position to where it was can automatically and promptly open the lock by the controlling of a pressing button.

In accordance with the present invention, the fixed latch lock comprises:

a housing with symmetrically placed holes at the front and the rear of the housing and a movable shaft latch passing through such holes. On both sides of the rear, there is a vertical gliding channel for inlaying in a controlling plate;

a shaft latch, at the bottom of the head of the shaft latch, there is a notch; and at some proper place outside the notch, there stands a small abutment;

a pressing spring that extends around the front of the shaft latch;

a controlling plate on the center of which is located a hole with the shaft latch passing therethrough. A projection extends on the top of the plate with two notches formed on the bottom of the plate. The projecting edges on both sides, respectively keep the projecting edges of the controlling plate inlay into the gliding channel of the housing and moving vertically as it glides.

A bottom stand set firmly at the bottom of the housing, and a spring sheet set firmly on the bottom stand. Two arms extend upwardly at an incline from the spring sheet to fit into the notches at the bottom of the controlling plate so that the vertical moving of the controlling plate can be under control.

A pressing button in hat shape, which pressing button is placed up on the controlling plate on the top of the housing. The interior of the pressing button is hollow, and the hollow interior covers the projection which is on the top of the controlling plate; and a fixing stand with fixing hole.

According to this invention, when latching the lock, it is only necessary to push the shaft latch forward manually. As the notch of the shaft latch passes through the hole in the controlling plate, the controlling plate is subjected to an upward force or push from the spring sheet set firmly on the bottom stand and jumps up to fit into the notch of the shaft latch, firmly holding the shaft latch and latched in the fixing hole in the fixing stand. When unlocking the lock, it is only necessary to press the pressing button to push the controlling plate moving it downward, so that the notch of the shaft latch detaches free and clear from the fitting position with the controlling plate so that the shaft latch subjected to the pressing force from the pressing spring at the front will be pressed back automatically to where it was from the latching position.

DESCRIPTION OF THE DRAWINGS

FIG. 1 is a side elevation of the fixed latch lock as it is unlocked;

FIG. 2 is a vertical section taken through the plane 2—2 in FIG. 3;

FIG. 3 is a sectional view taken along 3—3 in FIG. 1;

FIG. 4 is a sectional view taken along 4—4 in FIG. 1;

FIG. 5 is a partial plan of the bottom stand, including the spring sheet on the bottom stand;

FIG. 6 is a front view of the present fixed latch lock as being latched;

FIG. 7 is a vertical section of FIG. 6; and

FIG. 8 is a sectional view taken along 8—8 in FIG. 6.

DETAILED DESCRIPTION

Referring to FIG. 1, the fixed latch lock according to the present invention comprises a housing 10, with holes 11, 12 symmetrically located at the front and the rear of the housing 10, and a movable shaft latch 13 passing through holes 11, 12; adjacent the left and the right of the rear end of housing 10 extends a projection 15 respectively, this projection 15 forms a guiding channel 14 having a control plate 16 disposed therein for upward or downward movement.

Referring to FIG. 3, there is a hole 17 in the center of control plate 16 through which a shaft latch 13 may pass. A projection 18 extends out on the top of the control sheet 16 and is covered by a hat shaped pressing button 28 on the top of the housing 10. At the bottom of the control sheet 16, two notches 19 are provided and a projecting edge 20 on each side to inlay the projecting edge 20 of the control sheet 16 into the guiding channel 14 of the housing 10 to facilitate vertical movement.

Referring to FIG. 2, the shaft latch 13 is seen to pass through the two holes 11, 12 which are set respectively at the rear and the front of the housing 10, and hole 17 which is provided on the control sheet 16 in the housing 10. At the bottom of the head of the shaft latch 13 there is a U-shape notch 21; and at some proper place out side the notch 21, a small abutment 22 is provided. Also, at the front of the shaft latch 13 between the abutment 22 and the front of the housing 10, a pressing spring 23 is provided around the shaft latch 13 to automatically press shaft latch 13 back to where it was.

At the bottom of the housing 10 there is a firmly secured bottom stand 24, with a sheet spring 25 from which stretches two arms 26,26 upward at an incline to fit into the two notches 19 which are provided at the bottom of the control sheet 16, so that the sheet spring 25 can be pressed to spring up.

To latch the lock, it is only necessary to follow the arrangement illustrated in FIG. 7, that is, push the shaft latch 13 along the direction of the arrow until the notch 21 on the shaft latch 13 passes through the hole 17 in the controlling plate 16, the force pushed upward from the spring sheet 25 which is set firmly on the bottom stand 24 will drive the controlling plate 16 up so that the bottom of hole 17 will fit into the notch 21 on the shaft latch 13 whereby the shaft latch 13 is firmly set and latched in the fixing hole 31 in the fixing stand 30 as may be seen at the left end of FIG. 7.

When it is desired that the lock be unlocked, one needs only to press the pressing button 28 which will drive the controlling plate 16, moving it downward so that the notch 21 on the shaft latch 13 is clear from the fitting position of hole 17 of the controlling plate 16, so that the shaft latch 13 under the pressure from the pressing spring 23 on the front will press back to where it was automatically and withdraw from the locking or fitting position with the fixing hole 31 in the fixing stand 30, as shown in FIG. 2.

While certain preferred embodiments of the invention have been illustrated by way of example in the drawings and particularly described, it will be understood that various modifications may be made in the structure and arrangements and that the invention is in no way limited to the embodiments shown.

I claim:

1. A latch lock comprising a housing with a front end and a rear end and a hole at each of said ends, a controlling plate movable up or down in the housing and having a fixing hole therethrough, an up-down movable pressing button located at and extending through the top of the housing, a shaft latch, a bottom stand set firmly at the bottom of the housing, a spring sheet set firmly on the bottom stand and against said controlling plate, the shaft latch being in alignment with the holes located at the front end and the rear end of the housing and the fixing hole and passing therethrough; the shaft latch having a U-shape notch on the underside thereof; a small abutment extending on the shaft latch at a location away from the notch; a pressing spring extending around the shaft latch between the front of the housing and the small abutment in compressed relationship therebetween; whereby as the notch is passed through the fixing hole in the controlling plate, the controlling plate taking the force pushed upward by the spring sheet set firmly on the bottom stand will be driven upwardly toward the notch on the shaft latch, until the notch of the shaft latch engages in the fixing hole on the controlling plate, the pressing button upon being pressed operates to push the controlling plate down so that the notch on the shaft latch disengages from the fitting position with the controlling plate and the shaft latch will take the force of the pressing spring at the front end and will press back to where it was automatically from the latching position with said fixing hole being located in the center of the controlling plate, a projection extending from the top of the controlling plate receiving the pressing button, two notches are formed at the bottom of the controlling plate with projecting edges on both sides of said notches respectively to inlay the controlling plate in a guiding channel in the housing so that the controlling plate can move freely along the guiding channel.

2. A latch lock as claimed in claim 1, wherein the installation of the pressing button is set up on the controlling plate adjacent the top of the housing, the interior of the pressing button is hollow and will cover the projection on the top of the controlling plate.

3. A latch lock as claimed in claim 1, wherein two arms extend upwardly at an incline from the spring sheet to fit into the notches on the bottom of the controlling plate respectively, to control the vertical moving of the controlling plate.

* * * * *